US009891575B2

(12) United States Patent
Ogawa et al.

(10) Patent No.: US 9,891,575 B2
(45) Date of Patent: Feb. 13, 2018

(54) IMAGE FORMING DEVICE, EXCHANGE UNIT AND METHOD FOR DETERMINING EXCHANGE UNIT

(71) Applicant: SOC Corporation, Tokyo (JP)

(72) Inventors: Toshitaka Ogawa, Tochigi (JP); Hiroo Arikawa, Tokyo (JP); Yuji Kuwana, Tochigi (JP)

(73) Assignee: SOC Corporation, Tokyo (JP)

( * ) Notice: Subject to any disclaimer, the term of this patent is extended or adjusted under 35 U.S.C. 154(b) by 0 days.

(21) Appl. No.: 15/482,819

(22) Filed: Apr. 10, 2017

(65) Prior Publication Data

US 2017/0261911 A1 Sep. 14, 2017

Related U.S. Application Data

(63) Continuation of application No. PCT/JP2014/077713, filed on Oct. 17, 2014.

(51) Int. Cl.
*G03G 15/00* (2006.01)
*G03G 21/18* (2006.01)

(52) U.S. Cl.
CPC ..... *G03G 15/80* (2013.01); *G03G 21/1875* (2013.01); *G03G 2215/0695* (2013.01)

(58) Field of Classification Search
CPC ..... G03G 15/80; G03G 21/1875; G03G 21/1878; G03G 21/1882; G03G 21/1889;
(Continued)

(56) References Cited

U.S. PATENT DOCUMENTS 6,104,888 A 8/2000 Kobayashi
6,233,409 B1 * 5/2001 Haines ..... B41J 2/17509 399/10

(Continued)

FOREIGN PATENT DOCUMENTS

JP H05-040373 2/1993
JP 07152289 A * 6/1995

(Continued)

OTHER PUBLICATIONS

"International Preliminary Report on Patentability; this report contains the following items: Form PCT/IB/338, PCT/IB/373, PCT/ISA237(cover sheet), PCT/ISA237(Box No. I), PCT/ISA237(Box No. V), and Form PCT/IB/336," dated Oct. 13, 2016, which is English translation of "Written Opinion of the International Searching Authority," pp. 1-16.

(Continued)

*Primary Examiner* — Carla Therrien
(74) *Attorney, Agent, or Firm* — JCIPRNET

(57) ABSTRACT

An image forming device includes an attachment part to which a toner unit having a fuse that can be molten by being supplied with an electric current is detachably attached, and a control part that applies each of a non-melting conduction signal corresponding to a first current supply state where the fuse is not molten and a melting conduction signal corresponding to a second current supply state where the fuse is molten to the fuse. The control part detects each of whether or not the fuse is molten by applying the non-melting conduction signal and whether or not the fuse is molten by applying the melting conduction signal. The control part determines whether or not the toner unit attached to the attachment part is a specific exchange unit on the basis of a detection result of whether or not the fuse is molten.

15 Claims, 16 Drawing Sheets

(58) Field of Classification Search
CPC ..... G03G 21/1892; G03G 2215/0695; G03G 2215/0697
See application file for complete search history.

(56) References Cited

U.S. PATENT DOCUMENTS

| | | | | |
|---|---|---|---|---|
| 2005/0254833 | A1 | 11/2005 | Yokoe | |
| 2010/0172659 | A1* | 7/2010 | Jeon | G03G 15/553 399/12 |

FOREIGN PATENT DOCUMENTS

| | | |
|---|---|---|
| JP | H08-083024 | 3/1996 |
| JP | H11-143304 | 5/1999 |
| JP | 2005-326731 | 11/2005 |

OTHER PUBLICATIONS

"International Search Report (Form PCT/ISA/210) of PCT/JP2014/077713", dated Jan. 20, 2015, with English translation thereof, pp. 1-3.

* cited by examiner

| Signal string number n | Signal string data | | | |
|---|---|---|---|---|
| | Signal array number m | Voltage code V (n, m) | Conduction time code T (n, m) | Comparison code J (n, m) |
| 1 | 1 | V(1,1) | T(1,1) | J(1,1) |
| | 2 | V(1,2) | T(1,2) | J(1,2) |
| | 3 | V(1,3) | T(1,3) | J(1,3) |
| | ••• | ••• | ••• | ••• |
| | M | V(1,M) | T(1,M) | J(1,M) |
| 2 | ••• | ••• | ••• | ••• |
| 3 | ••• | ••• | ••• | ••• |
| ••• | ••• | ••• | ••• | ••• |
| N−1 | ••• | ••• | ••• | ••• |
| N | 1 | V(N,1) | T(N,1) | J(N,1) |
| | 2 | V(N,2) | T(N,2) | J(N,2) |
| | 3 | V(N,3) | T(N,3) | J(N,3) |
| | ••• | ••• | ••• | ••• |
| | M | V(N,M) | T(N,M) | J(N,M) |

FIG. 6

IMAGE FORMING DEVICE, EXCHANGE UNIT AND METHOD FOR DETERMINING EXCHANGE UNIT

CROSS-REFERENCE TO RELATED APPLICATIONS

The present application is a continuation application of International Application number PCT/JP2014/077713, filed on Oct. 17, 2014. The content of this application is incorporated herein by reference in its entirety.

BACKGROUND OF THE INVENTION

The present invention relates to an image forming device, an exchange unit, and a method for determining the exchange unit.

An image forming device such as a copying machine, a printer, or the like has a configuration such that a user can exchange an exchange unit including expendable items such as toner. In such a configuration, it is desirable to attach a genuine product of the exchange unit to realize good performance of the image forming device.

On the other hand, there is a demand for reusing the exchange unit or the like from the viewpoint of effective utilization of resources, environmental protection, and the like, and a non-genuine product of the exchange units have come to be attached to the image forming device. A method for operating the image forming device to correspond to a non-genuine product when a user intentionally attaches the non-genuine product has been proposed.

For example, Japanese Unexamined Patent Application Publication No. 2005-326731 discloses a technique for making an operation mode of the image forming device to which a genuine product of the exchange unit is attached different from the operation mode of the image forming device to which a non-genuine product is attached. Here, whether the exchange unit is genuine or non-genuine is determined by comparing unit information stored in a memory of the exchange unit with corresponding unit information stored in a storage unit of the image forming device.

Because a specialist can decode a data code of the unit information stored in the memory of the exchange unit, the same or similar memory can be mounted on a non-genuine product by creating the memory by using the decoded data code. When a non-genuine product on which such a memory is mounted is attached to an image forming device, the image forming device erroneously recognizes it as a genuine product and executes an operation mode corresponding to the genuine product. In such a case, because an inappropriate operation mode is executed, problems such as lowering of printing quality or a failure of the device may occur.

BRIEF SUMMARY OF THE INVENTION

This invention focuses on these points, and the object of the invention is to appropriately determine whether or not an exchange unit attached to an image forming device is a specific exchange unit.

In one aspect of the present disclosure, there is provided an image forming device comprising: an attachment part to which an exchange unit having a fuse that can be molten by being supplied with an electric current is detachably attached; and a control part that applies each of a first conduction signal corresponding to a first current supply state where the fuse of a specific exchange unit is not molten and a second conduction signal corresponding to a second current supply state where the fuse of the specific exchange unit is molten to the fuse, the control part determining that the exchange unit attached to the attachment part is the specific exchange unit when the control part detects that the fuse is not molten by applying the first conduction signal and also detects that the fuse is molten by applying the second conduction signal, and the control part determining that the exchange unit attached to the attachment part is an exchange unit other than the specific exchange unit when the control part detects that the fuse is molten by applying the first conduction signal or when the control part detects that the fuse is not molten by applying the second conduction signal.

BRIEF DESCRIPTION OF THE DRAWINGS

FIG. 6 is a diagram showing an example of conduction signal information stored in a storage part 92.

DETAILED DESCRIPTION OF THE INVENTION

<Configuration of an Image Forming Device>

Figure 1:
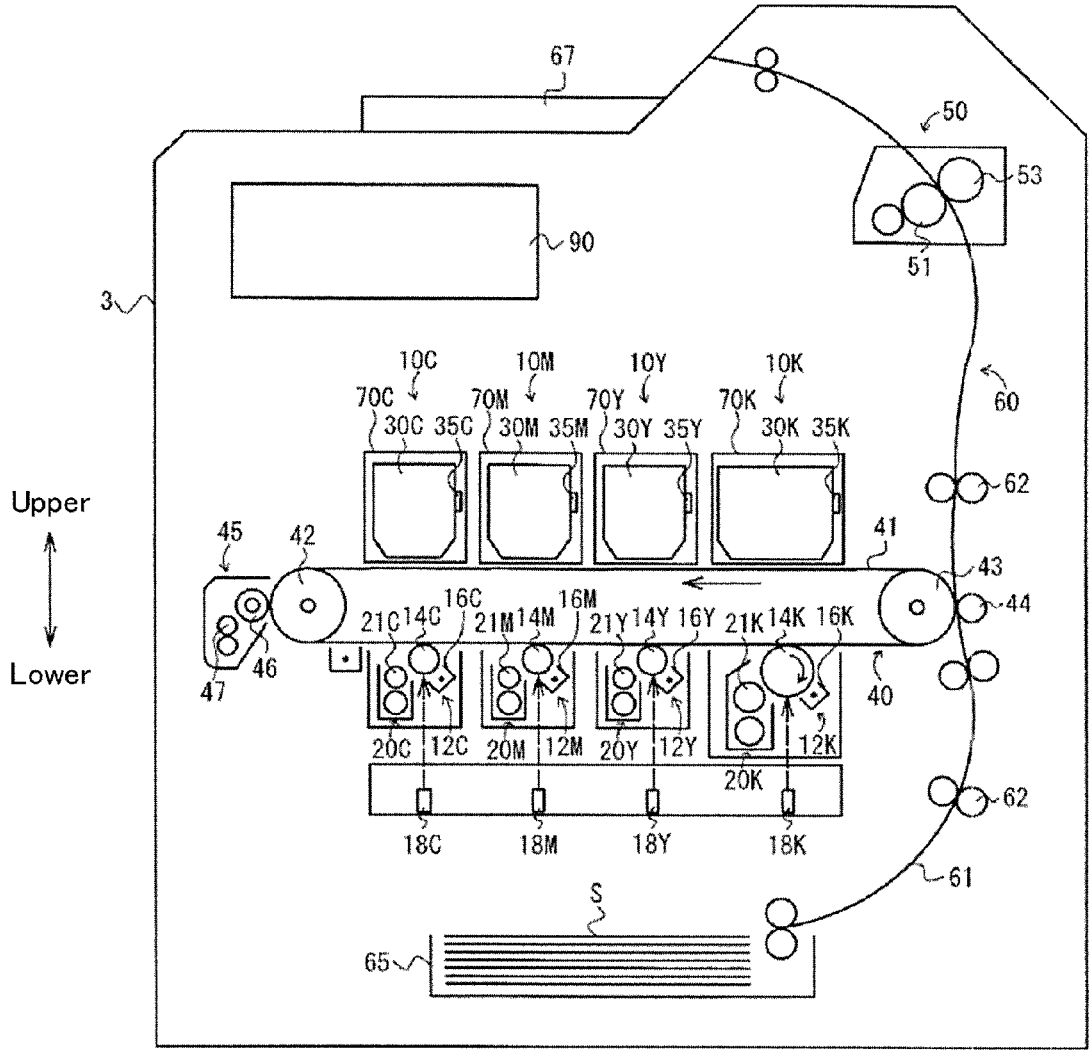
FIG. 1 is a diagram showing an example of an outline configuration of an image forming device 1 according to one exemplary embodiment of the present invention.

A configuration example of an image forming device 1 according to one exemplary embodiment of the present invention is explained with reference to FIG. 1. FIG. 1 is a diagram showing an example of an outline configuration of the image forming device 1. In FIG. 1, the vertical direction is indicated by an arrow and, for example, a paper feed cassette 65 is arranged at the lower part of a device main body 3 and a paper discharge tray 67 is arranged at the upper part of the device main body 3.

Here, the image forming device 1 is an electrophotographic laser beam printer, and forms an image on a paper S by receiving an image signal from an external device such as a computer. As shown in FIG. 1, the image forming device 1 includes process units 10K, 10Y, 10M, and 10C, a transfer unit 40, a cleaning unit 45, a fixing unit 50, a conveyance unit 60, and a control circuit 90.

The process units 10K, 10Y, 10M, and 10C have a function of visualizing latent images as toner images using toner as a developer after forming the latent images on photoreceptors 14K, 14Y, 14M, and 14C. The process units 10K, 10Y, 10M and 10C are provided corresponding to the respective colors of black (K), yellow (Y), magenta (M), and cyan (C). As shown in FIG. 1, the process units 10K, 10Y, 10M, and 10C are arranged in a row in the horizontal direction.

While the process units 10Y, 10M, and 10C from among the four process units 10K, 10Y, 10M, and 10C have the same size, the process unit 10K is enlarged so as to cope with a large amount of monochrome printing. Since the four process units 10K, 10Y, 10M, and 10C have similar basic configurations, the configuration of the process unit 10K will be explained here.

After a latent image is formed on the photoreceptor 14K, the process unit 10K visualizes the latent image as a black toner image using black toner. The process unit 10K includes a photosensitive unit 12K, an exposure unit 18K, a developing unit 20K, and a toner unit 30K.

The photosensitive unit 12K includes the photoreceptor 14K and an electrifier 16K. The photoreceptor 14K has a photosensitive layer on the outer periphery of a drum and carries a latent image on the surface of the photosensitive layer. The photoreceptor 14K is rotatably supported by the device main body 3 and rotates clockwise in FIG. 1. The electrifier 16K electrifies the photoreceptor 14K.

The exposure unit 18K forms a latent image on the electrified photoreceptor 14K by irradiating the photoreceptor 14K with a laser. That is, an electrostatic latent image corresponding to the print image is formed on the photoreceptor 14K.

The developing unit 20K contains black toner, and develops (visualizes) the latent image formed on the photoreceptor 14K as a black toner image using the black toner. The developing unit 20K has a developing roller 21K carrying the black toner, and develops the latent image on the photoreceptor 14K as a toner image by applying a developing bias to the developing roller 21K.

The toner unit 30K contains the black toner to be supplied to the developing unit 20K. The toner unit 30K is detachably attached to an attachment part 70K. Between the toner unit 30K and the developing unit 20K, a supply mechanism, which is not shown in figures, for supplying the black toner in the toner unit 30K to the developing unit 20K is provided. Further, a fuse 35K, whose details will be described later, for determining whether the toner unit 30K is a genuine product or a non-genuine product is attached to the toner unit 30K.

The transfer unit 40 transfers the toner images of the respective colors carried by the four photoreceptors 14K, 14Y, 14M, and 14C onto the paper S. The transfer unit 40 includes a transfer belt 41, a driving roller 42, a transfer roller 43, and a transfer back-up roller 44. The transfer belt 41 is stretched around the driving roller 42 and the transfer roller 43, and is rotated by the driving roller 42 in the direction of the arrow shown in FIG. 1. The transfer belt 41 is in contact with the photoreceptors 14K, 14Y, 14M, and 14C, and the toner images on the photoreceptors are primarily transferred onto the transfer belt 41 by applying a primary transfer bias at the contact part between the transfer belt 41 and the photoreceptors. The transfer belt 41 moves the primarily transferred toner images by rotating in a state of carrying the toner images. The transfer roller 43 and the transfer back-up roller 44 sandwich the paper S conveyed from the paper feed cassette 65. By applying a secondary transfer bias to the transfer roller 43 and the transfer back-up roller 44, single-color toner images or full-color toner images on the transfer belt 41 are secondarily transferred to the paper S.

The cleaning unit 45 removes residual toner that is not secondarily transferred to the paper S and remains on the transfer belt 41. The cleaning unit 45 has a cleaning roller 46 and a bias roller 47, and mechanically and electrically cleans the transfer belt 41. The cleaning roller 46 is a brush roller that is in contact with the transfer belt 41 while rotating. It should be noted that the cleaning unit 45 may have a cleaning blade instead of the brush roller.

The fixing unit 50 heats and presses the single-color toner images or the full-color toner images transferred onto the paper S and fuses the images to the paper S to form a permanent image. The fixing unit 50 includes a heat roller 51 and a fixing back-up roller 53, and sandwiches the paper S using them. The heat roller 51 heats and presses while contacting the toner image transferred onto the paper S.

The conveyance unit 60 draws out the papers S stacked in the paper feed cassette 65 one by one, conveys the delivered paper S, and discharges the paper S to the paper discharge tray 67. The conveyance unit 60 includes a conveyance path 61 through which the paper S is conveyed and a plurality of conveyance rollers 62 provided in the conveyance path 61. When the conveyance roller 62 conveys the paper S, the transfer unit 40 performs the above-described secondary transfer of the toner image, and the fixing unit 50 performs the above-described fixing of the toner image.

The control circuit 90 controls each unit described above. An image signal and a control signal are inputted to the control circuit 90 from, for example, a computer connected to the image forming device 1. The control circuit 90 controls each unit to form an mage on the basis of the inputted image signal and control signal. Further, the control circuit 90 is electrically connected to each unit and controls each unit while detecting the state of each unit by receiving a signal from a sensor or the like.

<Operation of the Image Forming Device at Image Formation>

The image forming device 1 having the above-described configuration can form a monochrome image or a color image on the paper S. In the following, an example of operation of the image forming device 1 at color image formation will be described with reference to FIG. 1.

First, when the image signal and the control signal from the computer are inputted to the control circuit 90, the photoreceptors 14K, 14Y, 14M, 14C, the transfer belt 41, and the like are rotated under the control of the control circuit 90.

The photoreceptors 14K, 14Y, 14M, and 14C are uniformly electrified by the electrifiers 16K, 16Y, 16M, and 16C at the electrifying position while rotating. The electrified areas of the photoreceptors 14K, 14Y, 14M and 14C that are electrified reach the exposure positions in accordance with the rotation of the photoreceptors, and latent images corresponding to image information of black (K), yellow (Y), magenta (M), and cyan (C) are formed in the electrified areas by the exposure units 18K, 18Y, 18M, and 18C.

The latent images formed on the photoreceptors 14K, 14Y, 14M, and 14C reach the developing positions in accordance with the rotation of the photoreceptors, and the latent images are developed into toner images by the developing units 20K, 20Y, 20M, and 20C. When the toner is consumed by the development performed by the developing units 20K, 20Y, 20M, and 20C, the toner is replenished to the developing units from the toner units 30K, 30Y, 30M, and 30C.

Single-color toner images (a black toner image or the like) formed on the photoreceptors 14K, 14Y, 14M, and 14C reach the primary transfer positions where the primary transfer bias is applied between the photoreceptors and the transfer belt 41 in accordance with the rotation of the photoreceptors 14K, 14Y, 14M, and 14C, and the single-color toner images are primarily transferred to the transfer belt 41. Then, a full-color toner image is formed on the transfer belt 41 by primarily transferring the toner images carried by the four photoreceptors 14K, 14Y, 14M, and 14C.

The full-color toner image formed on the transfer belt 41 reaches the secondary transfer position where the secondary transfer bias is applied between the transfer roller 43 and the transfer back-up roller 44 in accordance with the rotation of the transfer belt 41, and the full-color toner image is secondarily transferred to the paper S conveyed from the paper feed cassette 65. It should be noted that the toner that is not secondarily transferred to the paper S and remains on the transfer belt 41 is moved in accordance with the rotation of the transfer belt 41 and is removed by the cleaning roller 46.

The paper S on which the full-color toner image is secondarily transferred is conveyed to the fixing unit 50 by the conveyance roller 62. The full-color toner image is fused on the paper S by being heated and pressed by the heat roller 51. As a result, the image is formed on the paper S. The paper S, on which the image is formed, is further conveyed and is discharged from the paper discharge tray 67.

<Fuse of an Exchange Unit>

The image forming device 1 has a configuration by which an exchange unit is detachably attached. The exchange unit is an item similar to consumable supplies whose lifetime is shorter than the service lifetime of the main device main body 3 of the image forming device 1, and is a unit assumed to be exchanged by a user or a service person.

In the present exemplary embodiment, the photosensitive units 12K, 12Y, 12M, 12C, the developing unit 20K, 20Y, 20M, 20C, the toner unit 30K, 30Y, 30M, 30C, the cleaning unit 45, the fixing unit 50, and the like shown in FIG. 1 correspond to the exchange unit. The device main body 3 is provided with an attachment part to which the exchange unit is detachably attached. For example, the toner units 30K, 30Y, 30M, and 30C are respectively attached to the attachment parts 70K, 70Y, 70M, and 70C shown in FIG. 1 in a detachable manner.

The exchange unit is provided with a fuse that can be molten by being supplied with a current in order to determine whether or not the exchange unit attached to the attachment part is a specific exchange unit. A fuse is a component having a predetermined pre-arcing time-current characteristic, and is molten depending on a combination of a predetermined conduction current and conduction time. In the following description, the toner units 30K, 30Y, 30M, and 30C will be described as the exchange units. The fuses 35K, 35Y, 35M, and 35C are provided in the toner units 30K, 30Y, 30M, and 30C as shown in FIG. 1. The fuses 35K, 35Y, 35M, and 35C have the same configuration. For convenience of explanation, the toner units 30K, 30Y, 30M, and 30C will be generally referred to as a toner unit 30, and the fuses 35K, 35Y, 35M, and 35C will be generally referred to as a fuse 35.

Figure 2:
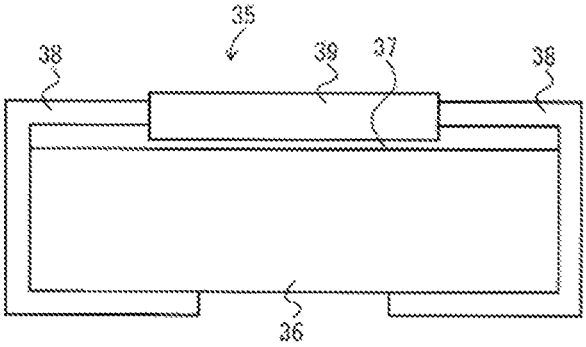
FIG. 2 is a schematic view showing an example of a cross-sectional configuration of a fuse 35 of a toner unit 30.

FIG. 2 is a schematic view showing an example of a cross-sectional configuration of the fuse 35 of the toner unit 30. As shown in FIG. 2, the fuse 35 has a substrate 36, a fuse element 37, a terminal 38, and an overcoat 39.

The substrate 36 is an insulating substrate made of, for example, ceramics or the like. The fuse element 37 is a fuse element which generates heat and melts by being supplied with an electric current. When the fuse element 37 generates heat and the temperature thereof rises to the melting point, the fuse element 37 melts. The terminal 38 is connected to both ends of the fuse element 37. The terminal 38 is connected to the unit-side circuit 80 (see FIG. 5) of the toner unit 30. The overcoat 39 is made of, for example, an insulating resin material and covers the upper part of the fuse element 37. The fuse 35 having the above-described configuration has a unique pre-arcing time-current characteristic as shown in FIG. 3.

Figure 3:
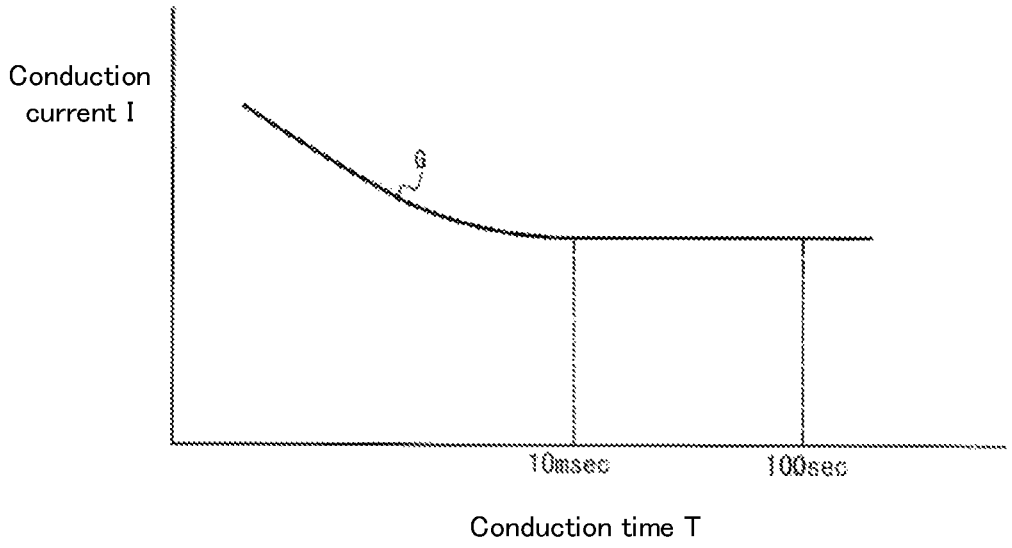
FIG. 3 is a graph showing a pre-arcing time-current characteristic curve of the fuse 35.

FIG. 3 is a graph showing a pre-arcing time-current characteristic curve G of the fuse 35. The pre-arcing time-current characteristic curve G shows the relationship between the conduction current and the conduction time for melting the fuse 35. In the graph of FIG. 3, the horizontal axis represents the conduction time T, and the vertical axis represents the conduction current I. The horizontal axis and the vertical axis both have a logarithmic scale. Generally, the fuse 35 is molten after a short conduction time T when the conduction current I is large, and is molten after a long conduction time T when the conduction current I is small.

The calorific value $Q_0$ of the fuse element 37 of the fuse 35 is related to the resistivity of the fuse element 37, the conduction current density (a current-carrying cross-sectional area of the fuse element 37 with the conduction current I), the conduction time T, and the like. On the other hand, the calorific value $Q_x$ that is necessary for melting the fuse 35 is determined from the amount of heat required to raise the temperature of the fuse element 37 to the melting point and the amount of heat absorbed by the substrate 36, the terminal 38, and the overcoat 39. The fuse 35 is molten when the condition $Q_0>Q_x$ is satisfied, but the conduction current I and the conduction time T for actually melting the fuse 35 are determined by many factors related to a melting mechanism of the fuse 35. By quantitatively managing each factor, the pre-arcing time-current characteristic curve G of the fuse 35 as shown in FIG. 3 is obtained.

As shown in FIG. 3, the fuse 35 has a basic nature of increasing the conduction time T required for melting when the value of the conduction current I is decreased. When the value of the conduction current I is further decreased, the pre-arcing time-current characteristic curve G often becomes a substantially horizontal straight line. The pre-arcing time-current characteristic curve G of a typical fuse has a substantially horizontal straight line in a region where the conduction time T is from about 10 msec to 100 sec. This region is called the minimum melting current region, and the current value of the conduction current I representing the minimum melting current region is called the minimum melting current value.

In this exemplary embodiment, it is determined whether or not the toner unit 30 attached to the attachment part 70 is a specific toner unit (more specifically, a genuine toner unit) by effectively utilizing the pre-arcing time-current characteristic of the above-described fuse 35. Specifically, a conduction signal is applied to the fuse 35 of the toner unit 30, and the toner unit 30 is determined to be genuine or non-genuine by detecting whether or not the fuse 35 is molten by the applied conduction signal. Such determination is realized by cooperation of the control circuit 90 of the device main body 3 and the unit-side circuit 80 including the fuse 35 of the toner unit 30.

The conduction signal applied to the fuse 35 is a signal string in which the non-melting conduction signal and the melting conduction signal are combined and arrayed. The non-melting conduction signal is a first conduction signal corresponding to a first current supply state where the fuse 35 is not molten, and the melting conduction signal is a second conduction signal corresponding to a second current supply state where the fuse 35 is molten. The non-melting conduction signal and the melting conduction signal correspond to characteristic points on the pre-arcing time-current characteristic curve.

Figure 4:
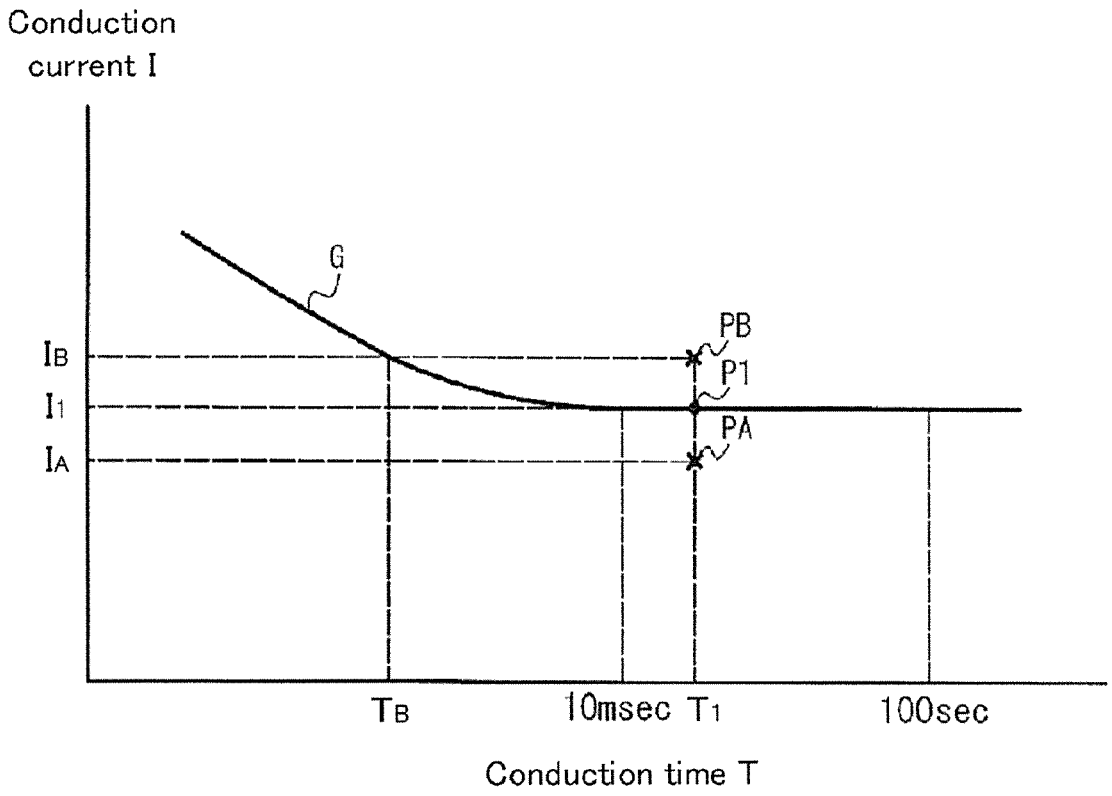
FIG. 4 is a diagram for explaining an example of a melting conduction signal and a non-melting conduction signal.

FIG. 4 is a diagram for explaining an example of the melting conduction signal and the non-melting conduction signal. The characteristic point P1 shown in FIG. 4 is set in the minimum melting current region of the pre-arcing time-current characteristic curve described above. The conduction current of the characteristic point P1 is the minimum melting current value $I_1$, and the conduction time of the characteristic point P1 is $T_1$. For example, the conduction current $I_1$ is about 200 mA and the conduction time $T_1$ is about 0.5 sec.

The melting conduction signal and the non-melting conduction signal are each set by the current value of the conduction current and the conduction time based on the pre-arcing time-current characteristic curve G of the fuse 35. For example, the melting conduction signal corresponds to a characteristic point PB having a current value larger than the characteristic point P1 on the graph, and is composed of the conduction time $T_1$ of the characteristic point P1 and a conduction current $I_B$ larger than the conduction current $I_1$ of the characteristic point P1. The non-melting conduction signal corresponds to a characteristic point PA having a current value smaller than the characteristic point P1 on the graph, and is composed of the conduction time $T_1$ of the characteristic point P1 and a conduction current $I_A$ which is smaller than the conduction current $I_1$ of the characteristic point P1. Hence, the current value of the melting conduction signal is different from the current value of the non-melting conduction signal.

When the melting conduction signal of the conduction current $I_B$ is applied to the fuse 35, the fuse 35 is molten after the conduction time $T_B$ that is shorter than the conduction time $T_1$, as can be seen from the graph. It should be noted that the conduction current $I_B$ of the melting conduction signal is set so that the conduction time $T_B$ is sufficiently smaller than the conduction time $T_1$.

It should be noted that, in the minimum melting current region, the fluctuation of the current value is small due to the characteristics of the pre-arcing time-current characteristic curve G of the fuse 35. Therefore, fuses having different pre-arcing time-current characteristic curves can be appropriately distinguished by setting the characteristic point P1 in the minimum melting current region and by making the voltages of the non-melting conduction signal and the melting conduction signal different from the current value of the characteristic point P1.

<Configuration of the Control Circuit 90 and the Unit-Side Circuit 80>

Figure 5:
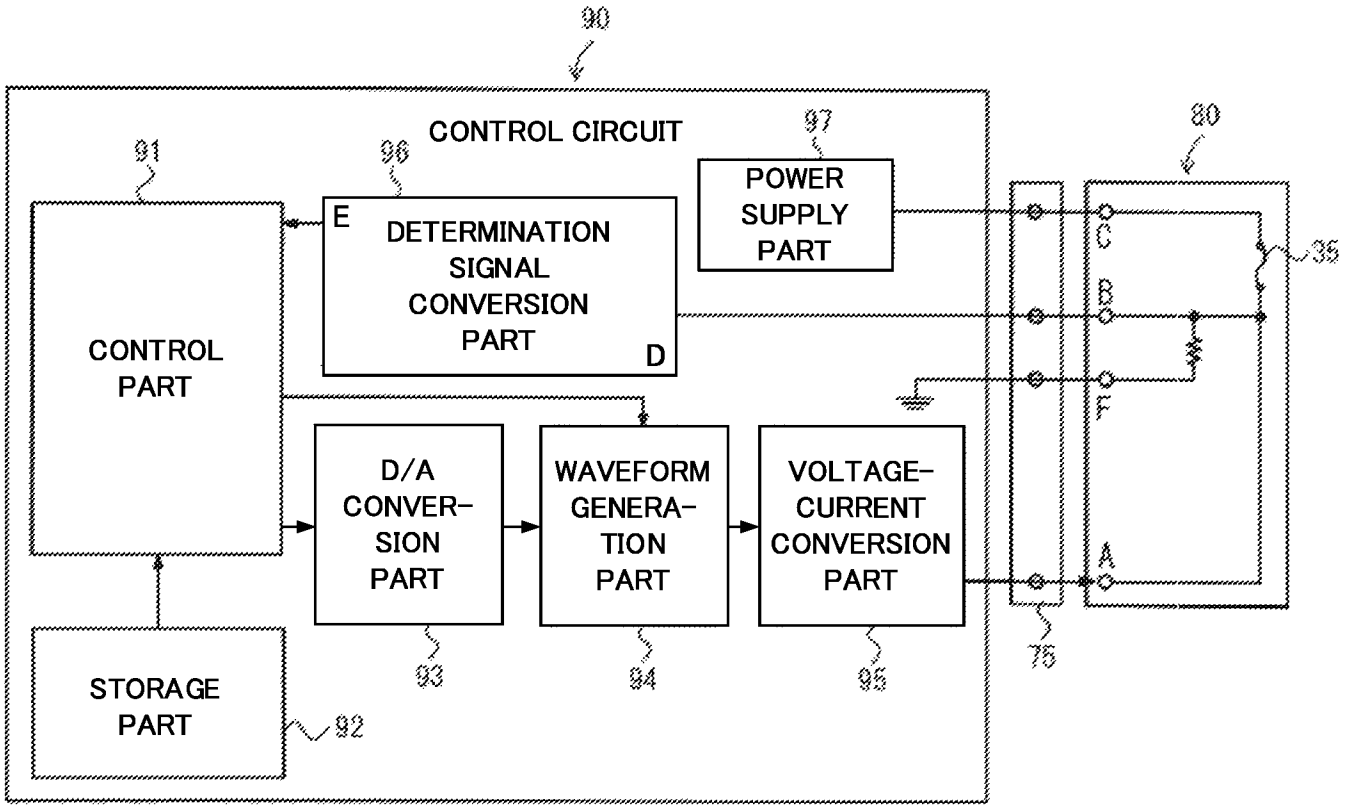
FIG. 5 is a block diagram for explaining an example of configurations of a control circuit 90 and a unit-side circuit 80.

With reference to FIG. 5, configurations of the control circuit 90 and the unit-side circuit 80 for determining whether or not the exchange unit is the specific exchange unit will be described. FIG. 5 is a block diagram for explaining an example of the configurations of the control circuit 90 and the unit-side circuit 80.

In the present exemplary embodiment, the unit-side circuit 80 to which the above-described fuse 35 is connected is attached to the toner unit 30. The unit-side circuit 80 is electrically connected to the control circuit 90 of the device main body 3 via a connector 75. As shown in FIG. 5, the control circuit 90 includes a control part 91, a storage part 92, a D/A conversion part 93, a waveform generation part 94, a voltage-current conversion part 95, and a determination signal conversion part 96.

The control part 91 applies a signal string obtained by combining the non-melting conduction signal and the melting conduction signal to the fuse 35, and detects each of whether or not the fuse 35 is molten due to the application of the non-melting conduction signal and whether or not the fuse 35 is molten due to the application of the melting conduction signal. Then, the control unit 91 determines whether or not the toner unit 30 attached to the attachment part 70 is a genuine product (a specific exchange unit) on the basis of the detection result of whether or not the fuse 35 is molten.

The control part 91 outputs a digital voltage signal to the D/A conversion part 93. In addition, the control part 91 outputs, to the waveform generation part 94, a conduction time signal for determining a conduction time and a conduction timing of the conduction signal to the fuse 35. The digital voltage signal and the conduction time signal are set on the basis of the conduction signal information stored in the storage part 92.

The storage part 92 stores programs executed by the control part 91 and data to be used when the control part 91 performs control. Further, the storage part 92 stores conduction signal information on conduction signals to be applied to the fuse 35 of the toner unit 30, which is an exchange unit. Specifically, the storage part 92 stores a plurality of pieces of signal string data whose patterns of conduction signals are different from each other.

FIG. 6 is a diagram showing an example of the conduction signal information stored in the storage part 92. The conduction signal information is the information in which a signal string number n and signal string data are associated. The signal string number n is a number (1 to N) for specifying a conduction signal that is actually applied to the fuse 35 from among a plurality of stored signal strings. One piece of signal string data is set for each of the signal string numbers n. The signal string data is composed of a signal array number m, a voltage code V (n, m), a conduction time code T (n, m), and a comparison code J (n, m). It should be noted that the signal string data corresponding to the signal string numbers 2 to N−1 are omitted in FIG. 6 for convenience of explanation.

The signal array number m indicates the arrayed position in the signal string of the melting conduction signal and the non-melting conduction signal composing the signal string. The voltage code V (n, m) indicates a value for determining the voltage outputted from the control part 91 to the D/A conversion part 93. The conduction current value of the melting conduction signal or the conduction current value of the non-melting conduction signal is determined on the basis of the value of the voltage code V (n, m). The conduction time code T (n, m) indicates a numerical value for determining the signal outputted from the control part 91 to the waveform generation part 94. The conduction time or the like of the conduction signal are determined on the basis of the numerical value of the conduction time code T (n, m).

The comparison code J (n, m) is a code indicating the fuse 35 being molten or the fuse 35 not being molten. Here, the code of the comparison code J (n, m) is 0 or 1. The comparison code J (n, m)=1 indicates that the fuse 35 was molten, and the comparison code J (n, m)=0 indicates that the fuse 35 was not molten. That is, the storage part 92 stores setting information on whether or not the fuse 35 is molten corresponding to each of the applications of the melting conduction signal and of the non-melting conduction signal to the fuse 35.

Returning to FIG. 5, the D/A conversion part 93 converts the digital voltage signal inputted from the control part 91 into an analog voltage signal. The D/A conversion part 93 outputs the converted analog voltage signal to the waveform generation part 94.

The waveform generation part 94 generates a voltage signal waveform in which the analog voltage signal inputted from the D/A conversion part 93 and the conduction time signal inputted from the control part 91 are synchronized. The waveform generation part 94 outputs the generated voltage signal waveform to the voltage-current conversion part 95. It should be noted that the D/A conversion part 93 and the waveform generation part 94 includes, for example, a Pulse Width Modulation (PWM) signal output circuit and a smoothing circuit.

The voltage-current conversion part 95 converts the voltage signal waveform inputted from the waveform generation part 94 into a predetermined current signal waveform. The voltage-current conversion part 95 outputs the converted current signal waveform to the unit-side circuit 80 via the connector 75 as a conduction signal.

Figure 7:
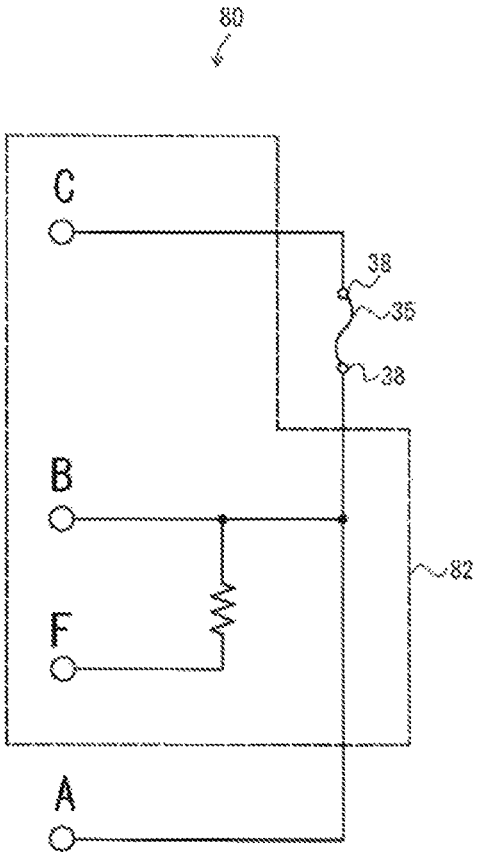
FIG. 7 is a circuit diagram showing a configuration of the unit-side circuit 80.

The configuration of the unit-side circuit 80 will be described with reference to FIG. 7. FIG. 7 is a circuit diagram showing the configuration of the unit-side circuit 80. The unit-side circuit 80 has an input terminal A, an output terminal B, a power supply terminal C, and the fuse 35. Between the output terminal B and the fuse 35, there is provided a pull-down resistor having one end connected to the ground of the device main body 3 side via a terminal F.

The input terminal A is connected to the voltage-current conversion part 95 of the control circuit 90 via the connector 75. A conduction signal from the voltage-current conversion part 95 is inputted to the input terminal A. The fuse 35 is connected in series between the input terminal A and the power supply terminal C connected to the power supply part 97 of the device main body 3, and the fuse 35 receives the conduction signal from the input terminal A.

The fuse 35 receives a non-melting conduction signal, which is a first conduction signal corresponding to the first current supply state where the fuse 35 is not molten, and a melting conduction signal, which is a second conduction signal corresponding to the second current supply state where the fuse 35 is molten, which are inputted from the control circuit 90. The fuse 35 melts when the conduction signal is the melting conduction signal, and the fuse 35 does not melt when the conduction signal is the non-melting conduction signal. The voltage between the terminals 38 in a state where the fuse 35 does not melt is larger than the voltage between the terminals 38 in a state where the fuse 35 melts.

Figure 8:
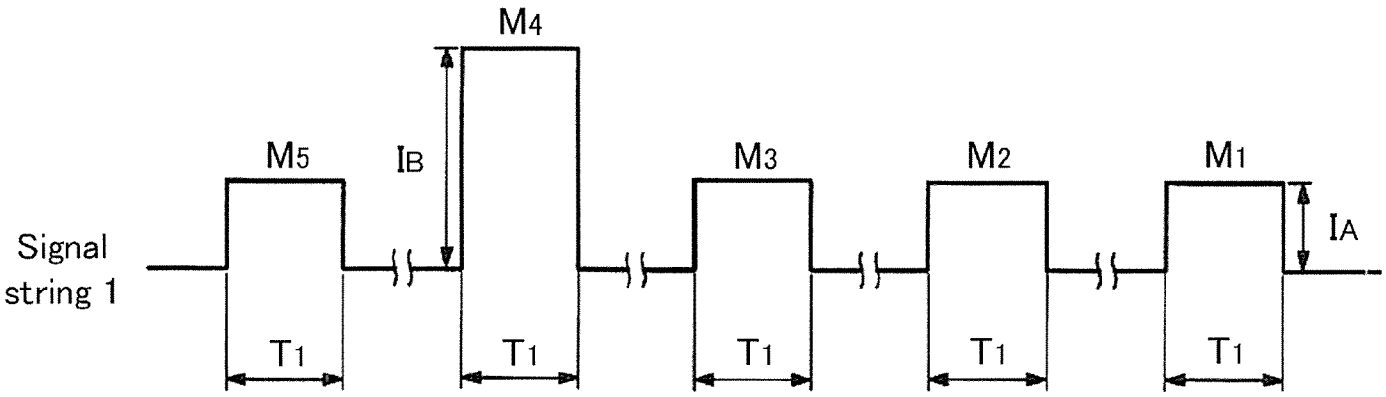
FIG. 8 is a diagram showing an example of a signal string 1 applied to a fuse 35.

A signal string applied to the fuse 35 will be described with reference to FIG. 8. FIG. 8 is a diagram showing an example of the signal string 1 applied to the fuse 35. The signal string 1 is set on the basis of the conduction time $T_1$ and the conduction current $I_1$ corresponding to the characteristic point P1 shown in FIG. 4. The signal string 1 is composed of five conduction signals $M_1$ to $M_5$, and is applied to the fuse 35 in the order of the conduction signal $M_1$, the conduction signal $M_2$, . . . , and the conduction signal $M_5$. The conduction signal $M_4$ is the melting conduction signal, and has the conduction current $I_B$ and the conduction time $T_1$. The conduction signals $M_1$, $M_2$, $M_3$, and $M_5$ are non-melting conduction signals, and each has the conduction current $I_A$ and the conduction time $T_1$.

Here, the signal string 1 is configured on the basis of the signal string data (the signal array number m is 1 to 5) of the signal string number n=1 in FIG. 6. Specifically, the conduction signal $M_1$ is configured on the basis of the data described in the row of the signal array number m=1 in FIG. 6, and the conduction signal $M_2$ is configured on the basis of the data described in the row of the signal array number m=2. At this configuration, 1 (melting) is allocated to the comparison code J (1, 4) corresponding to the conduction signal $M_4$ (m=4), which is the melting conduction signal, and the comparison code J (1, 5) corresponding to the conduction signal $M_5$ arrayed after the conduction signal $M_4$ in the comparison code J corresponding to the signal string 1. On the other hand, 0 (non-melting) is allocated to the comparison codes J (1, 1), J (1, 2), and J (1, 3) corresponding to the other three conduction signals $M_1$ to $M_3$.

In the present exemplary embodiment, the signal string is applied to the fuse 35 by being selected from a plurality of pieces of signal string data stored in the storage part 92. At this time, the control part 91 randomly selects one signal string from a plurality of signal strings and applies it to the fuse 35. For example, the control part 91 can select a signal string at random by determining the signal string number n by using software regarding random numbers. This makes it difficult to decode the signal string selected from the plurality of signal strings. Here, one signal string is selected, but a plurality of signal strings may be randomly selected.

Further, as can be seen from FIG. 8, the control part 91 applies the melting conduction signal to the fuse 35 after applying at least one non-melting conduction signal (here, three non-melting conduction signals) to the fuse 35. This makes it possible to reliably detect whether or not the fuse 35 is molten by the non-melting conduction signal and whether or not the fuse 35 is molten by the melting conduction signal.

Returning to FIG. 7, the output terminal B is connected to the determination signal conversion part 96 (FIG. 5) of the control circuit 90 via the connector 75. The output terminal B outputs i) the first voltage signal corresponding to the voltage between the terminals 38 when the fuse 35 is not molten and ii) the second voltage signal corresponding to the voltage between the terminals 38 when the fuse 35 is molten to the determination signal conversion part 96 via the connector 75. In the present exemplary embodiment, the first voltage signal has a voltage substantially equal to the voltage applied from the power supply part 97 to the power supply terminal C. Further, the second voltage signal has a voltage substantially equal to the ground voltage.

In the present exemplary embodiment, the region surrounded by a dashed line in FIG. 7 is a voltage signal output part 82 that is connected to the fuse 35. The voltage signal output part 82 has a function to output the first voltage signal to the control circuit 90 of the device main body 3 in a state where the fuse 35 is not molten, and to output the second voltage signal to the control circuit 90 of the device main body 3 in a state where the fuse 35 is molten.

Returning to FIG. 5, the determination signal conversion part 96 of the control circuit 90 converts the voltage signal inputted from the unit-side circuit 80 (specifically, the output terminal B) into the voltage signal of a level that can be determined by the control part 91 (that is, the determination signal). The determination signal conversion part 96 outputs the converted determination signal to the control part 91.

Figure 9:
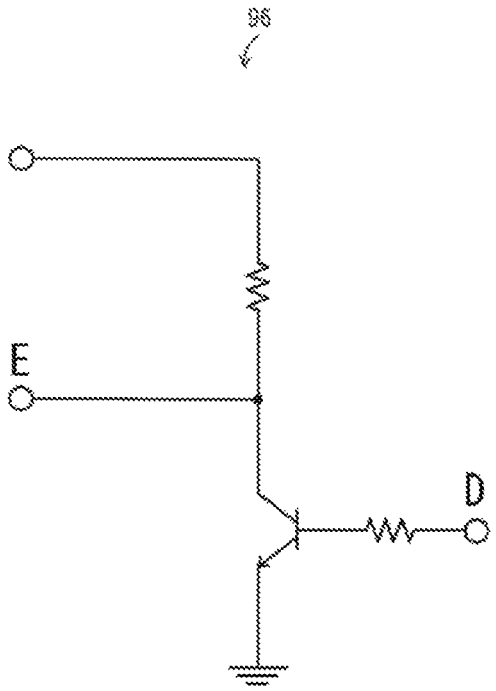
FIG. 9 is a circuit diagram showing an example of a configuration of a determination signal conversion part 96.

FIG. 9 is a circuit diagram showing an example of a configuration of the determination signal conversion part 96. The determination signal conversion part 96 includes an input terminal D and an output terminal E. A first voltage signal corresponding to a state where the fuse 35 is not molten and a second voltage signal corresponding to a state where the fuse 35 is molten are inputted to the input terminal D from the unit-side circuit 80. The inputted first voltage signal is converted into a first converted signal, which is sufficiently larger than a threshold voltage at which the control part 91 can determine ON/OFF, and the second voltage signal is converted to a second converted signal, which is sufficiently smaller than the threshold voltage. The output terminal E outputs the first converted signal and the second converted signal to the control part 91.

The control part 91 determines whether the toner unit 30 is a genuine product or not by detecting whether or not the fuse 35 is molten on the basis of the inputted first converted signal and the second converted signal. For example, when the fuse 35 is not detected to be molten by the application of the non-melting conduction signal and is also detected to be molten by the application of the melting conduction signal, the control part 91 determines that the toner unit 30 attached to the attachment part 70 is the specific exchange unit (a genuine product). On the other hand, when the fuse 35 is detected to be molten by the application of the non-melting conduction signal or when the fuse 35 is not detected to be molten by the application of the melting conduction signal, the control part 91 determines that the toner unit 30 attached to the attachment part 70 is an exchange unit other than the specific exchange unit (a non-genuine product). Accordingly, it is possible to determine whether the toner unit 30 is a genuine product or a non-genuine product according to a detection of whether or not the fuse 35 is molten with respect to the application of the conduction signal.

Further, the control part 91 determines whether or not the toner unit 30 attached to the attachment part 70 is a genuine product by comparing the detection result of whether or not the fuse 35 is molten with the comparison code J (n, m) stored in the storage part 92. Specifically, the control part 91 determines that the toner unit 30 is a genuine product when the detection result of whether or not the fuse 35 is molten matches the comparison code J (n, m), and the control part 91 determines that the toner unit 30 is a non-genuine product when the detection result of whether or not the fuse 35 is molten does not match the comparison code J (n, m). Accordingly, it is possible to easily and appropriately determine whether the toner unit 30 is a genuine product or a non-genuine product.

In the present exemplary embodiment, when the toner unit 30 is attached to the attachment part 70, the control part 91 determines whether or not the fuse 35 is molten by detecting the voltage between the terminals 38 of the fuse 35 of the toner unit 30 on the basis of whether the signal inputted from the toner unit 30 is the first voltage signal or the second voltage signal. When it is determined that the fuse 35 is not molten, the control part 91 determines whether or not the toner unit 30 is a genuine product by applying the non-melting conduction signal and the melting conduction signal to the fuse 35. In this way, there is no need to perform a determination process on the non-genuine toner unit 30 for which the fuse 35 is molten.

<Determination Process when an Exchange Unit is Attached>

A determination process at the time when an exchange unit is attached to an attachment part will be described with reference to FIG. 10 and FIG. 11. By taking the toner unit 30 as an example of an exchange unit, a process of determining whether the exchanged toner unit 30 is a genuine product or a non-genuine product will be described in the following.

Figure 10:
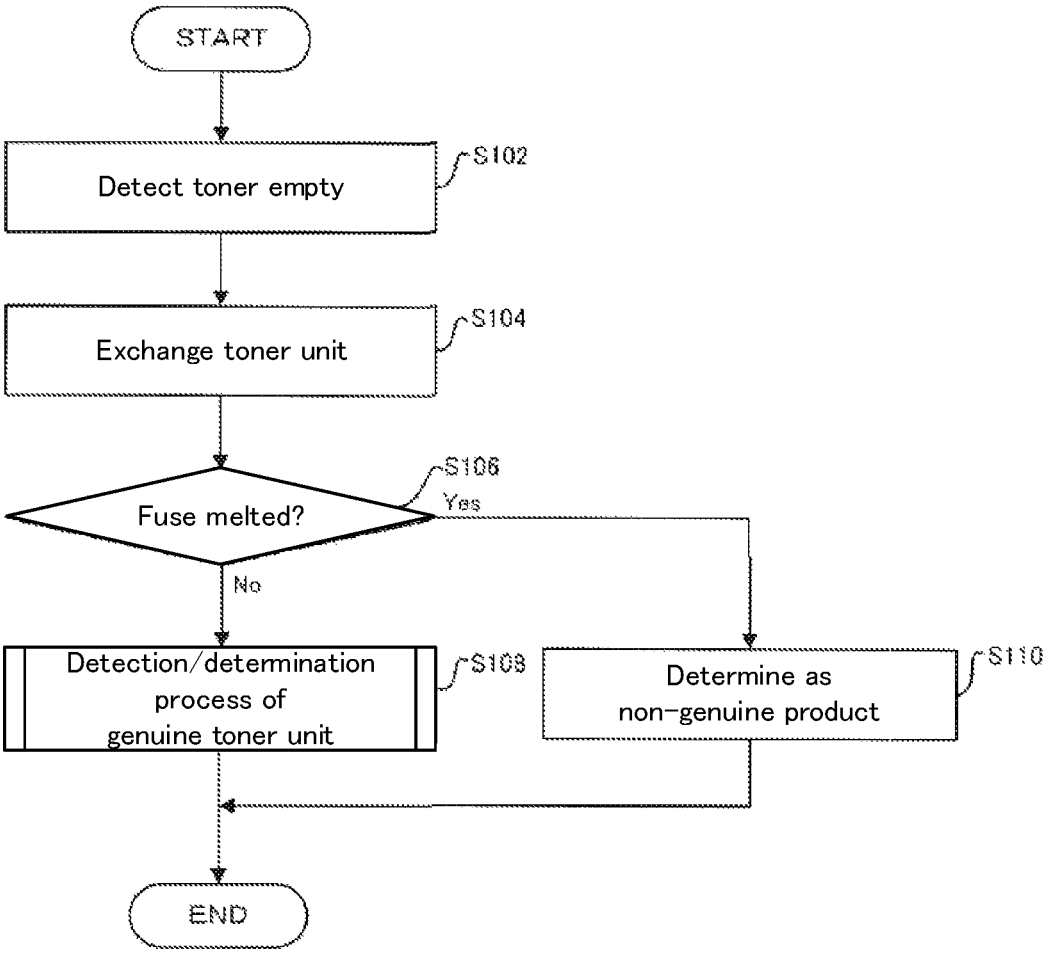
FIG. 10 is a flow chart showing an operation example of the image forming device 1 when the toner unit 30 is attached to an attachment part 70.

FIG. 10 is a flow chart showing an operation example of the image forming device 1 when the toner unit 30 is attached to the attachment part 70. The flow chart shown in FIG. 10 starts from the time when the toner in the toner unit 30 is consumed and the amount thereof becomes equal to or less than a predetermined amount, and "toner empty" is detected by a sensor (the sensor is mounted inside the toner unit 30) that is not shown in figures (step S102). When "toner empty" is detected, the control circuit 90 displays a message urging the exchange of the toner unit 30 on an operation panel which is not shown in the figures.

In accordance with the content displayed on the operation panel, a user removes the toner unit 30 attached to the attachment part 70 and attaches a new toner unit 30 to the attachment part 70 (step S104). When the control circuit 90 detects that the toner unit 30 is attached to the attachment part 70 by using a sensor or the like, the control circuit 90 detects whether the fuse 35 of the toner unit 30 is molten before starting the image forming operation (step S106). The control circuit 90 can determine whether or not the fuse 35 is molten on the basis of the magnitude of the voltage of the signal corresponding to the voltage between the terminals 38 of the fuse 35 outputted from the unit-side circuit 80.

When it is determined that the fuse 35 is molten in step S106 (Yes), the control circuit 90 determines that the toner unit 30 attached to the attachment part 70 is a non-genuine product (step S110). Then, the control circuit 90 displays a message that the attached toner unit 30 is a non-genuine product on, for example, the operation panel.

Figure 11:
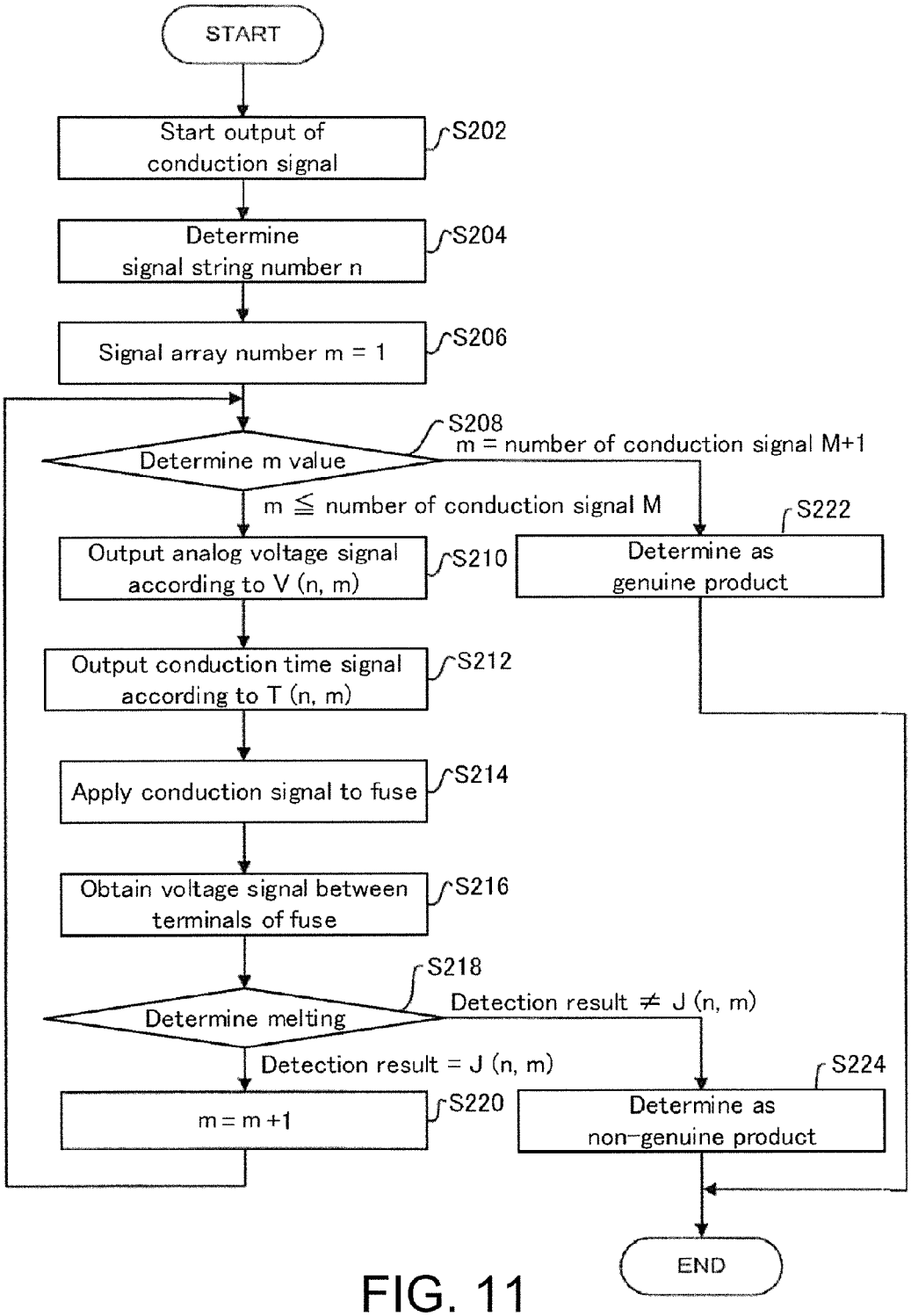
FIG. 11 is a flow chart showing an example of a detection and determination process of the toner unit 30.

On the other hand, when it is determined that the fuse 35 is not molten in step S106 (No), the control circuit 90 executes a detection/determination process of the toner unit 30 shown in FIG. 11 (step S108). Thus, it can be determined whether the toner unit 30 attached to the attachment part 70 is a genuine product or a non-genuine product.

FIG. 11 is a flow chart showing an example of the detection/determination process of the toner unit 30. First, the control circuit 90 starts outputting the conduction signal (step S202). Next, the control circuit 90 determines the signal string number n (step S204). Here, the signal string applied to the fuse 35 is assumed to be the signal string 1 shown in FIG. 8. Then, the signal string number n is "1" and the signal array number M is "5."

Subsequently, the control circuit 90 sets the signal array number m to "I" (step S206). Then, the control circuit 90 determines whether or not the value of the signal array number m is equal to or less than M (=5) (step S208). Here, since the signal array number m is "1," the control circuit 90 converts a digital voltage signal corresponding to the voltage code V (1, 1) into an analog voltage signal using the D/A conversion part 93 and outputs it to the waveform generation part 94 (step S210). Further, the control circuit 90 outputs the conduction time signal corresponding to the conduction time code T (1, 1) to the waveform generation part 94 (step S212). The waveform generation part 94 generates the voltage signal waveform in which the analog voltage signal and the conduction time signal are synchronized.

Next, the control circuit 90 applies the conduction signal $M_1$ obtained by converting the voltage signal waveform into the current signal waveform using the voltage-current conversion part 95 to the fuse 35 via the unit-side circuit 80 (step S214). Upon receipt of the conduction signal $M_1$, the fuse 35 is molten or not molten.

Next, the control circuit 90 obtains the voltage signal between the terminals 38 of the fuse 35 that receives the conduction signal $M_1$ from the unit-side circuit 80 (step S216). That is, the control circuit 90 obtains the first voltage signal corresponding to the voltage at which the fuse 35 is not molten or the second voltage signal corresponding to the voltage at which the fuse 35 is molten. The control circuit 90 determines whether or not the fuse 35 is molten on the basis of the obtained voltage signal (step S218).

Because the conduction signal $M_1$ is a non-melting conduction signal, the value of the comparison code J (1, 1) previously stored in the storage part 92 is "0." When the control circuit 90 receives the second voltage signal from the unit-side circuit 80, the control circuit 90 determines that the exchanged toner unit 30 is a non-genuine product because the detection result and the comparison code J (1, 1) do not match in step S218 (step S224). When the exchanged toner unit 30 is determined as a non-genuine product, the control circuit 90 displays a message that the attached toner unit 30 is a non-genuine product on, for example, the operation panel. In addition, the control circuit 90 displays a message urging the exchange of the toner unit 30 with a genuine product or executes a process of changing the operation condition of the image forming device 1 to the process corresponding to a non-genuine product.

On the other hand, when the control circuit 90 receives the first voltage signal from the unit-side circuit 80, the control circuit 90 determines that the detection result and the comparison code J (1, 1) match in step S218 and sets the value of m as "2" (step S220). Then, the control circuit 90 returns to the process of step S208 and repeats the processes of steps S208 to S218.

In the signal string 1 shown in FIG. 8, the conduction signal $M_4$ applied in the fourth order is the melting conduction signal. For this reason, when the toner unit 30 is a genuine product, the fuse 35 is not molten when the conduction signals $M_2$ and $M_3$ are applied to the fuse 35, and the detection result and the comparison code match in the routine of m=2, 3. Then, the fuse 35 is molten when the conduction signal $M_4$ is applied to the fuse 35, and the detection result and the comparison code J (1, 4) match in the routine of m=4. That is, the control circuit 90 determines that the fuse is molten with the first melting conduction signal included in the signal string 1.

The conduction signal $M_5$ applied in the fifth order in the signal string 1 is a non-melting conduction signal, but since it is a conduction signal after the conduction signal $M_4$, the comparison code J (1, 5) is stored as "1" (melting) in the storage part 92. Therefore, the detection result and the comparison code J (1, 4) match with each other in the routine of m=5, and the control circuit 90 determines that the toner unit 30 is a genuine product when it determines that m=M+1 (=6) (step S222).

It should be noted that, in the above description, the routine of m=5 is performed after it is determined that the fuse 35 is molten in the routine of in =4, but it is not so limited and the routine of m=5 does not have to be performed. That is, the routine of m=5 does not have to be performed in a case when the toner unit 30 is a genuine product since the toner unit 30 can be determined as a genuine product when the fuse 35 is molten in the routine of m=4. That is, the process of FIG. 11 may be ended at the timing when the toner unit is determined to be a genuine product or a non-genuine product before all conduction signals included in the signal string are applied to the fuse 35.

In the above description, the melting conduction signal was configured to be the fourth order in the signal string, but it is not so limited and it may be configured to be the second order or the third order of the signal string. Further, in the above description, the signal string includes five conduction signals, but it is not so limited and the number of conduction signals included in the signal string may be any of 2 to 4. In addition, the signal string includes one melting conduction signal, but it is not so limited and a plurality of melting conduction signals may be included.

Furthermore, in the above description, a signal string including the melting conduction signal and the non-melting conduction signal is applied to the fuse 35, but it is not so limited. For example, the melting conduction signal and the non-melting conduction signal may be independently applied to the fuse 35 without constituting a signal string.

<Effect of the Present Exemplary Embodiment>

As described above, the image forming device 1 according to the present exemplary embodiment applies the non-melting conduction signal and the melting conduction signal to the fuse 35, and detects each of whether or not the fuse 35 is molten by the non-melting conduction signal and whether or not the fuse 35 is molten by the melting conduction signal. Then, the image forming device 1 determines whether or not the toner unit, which is an exchange unit attached to the attachment part 70, is a specific exchange unit (a genuine product or a non-genuine product) on the basis of the detection result of whether or not the fuse is molten.

In such a configuration, by using the pre-arcing time-current characteristic of the fuse 35 having analog characteristics rather than using memory information stored in a memory chip mounted on a conventional toner unit, it is difficult even for a specialist to decode the conduction signal applied to the fuse 35 mounted on the toner unit 30 (that is, the non-melting conduction signal and the melting conduction signal having different current values). Particularly, it is difficult to detect the current value and the conduction time of the conduction signal applied to the fuse 35 in practical limitations. Further, the determination criterion can be flexibly changed by changing the position of the characteristic point on the pre-arcing time-current characteristic curve of the fuse 35 and changing the melting conduction signal and the non-melting conduction signal corresponding to the characteristic point. As a result, it is possible to appropriately determine whether the toner unit 30 mounted on the attachment part 70 is a genuine product or a non-genuine product.

Furthermore, in the present exemplary embodiment, because the signal string obtained by combining the melting conduction signal and the non-melting conduction signal is applied to the fuse 35, it is difficult for a specialist to decode the conduction information. Moreover, it is further difficult for the specialist to decode the conduction information because the signal string randomly selected from the plurality of signal strings stored in the storage part 92 is applied to the fuse 35.

Further, according to the present exemplary embodiment, because it is possible to appropriately determine whether the toner unit 30 attached to the attachment part 70 is a genuine product or a non-genuine product, it is possible to appropriately manage the image forming condition and the operating conditions of the image forming device 1 in accordance with the exchange of the toner unit 30. Accordingly, even when a non-genuine toner unit 30 is attached, the image forming device 1 can perform image formation under appropriate operating conditions corresponding to non-genuine products. As a result, image quality can be secured and maintenance of the image forming device 1 becomes possible, and so it is possible to ameliorate the disadvantage that has occurred to users and the like.

MODIFICATION EXAMPLES

In the above description, the control part 91 sets the melting conduction signal and the non-melting conduction signal to one characteristic point P1 on the pre-arcing time-current characteristic curve as shown in FIG. 4, but it is not so limited. For example, the control part 91 may set the melting conduction signal and the non-melting conduction signal on the basis of the current value and conduction time corresponding to each of two characteristic points.

The First Modification Example

Figure 12:
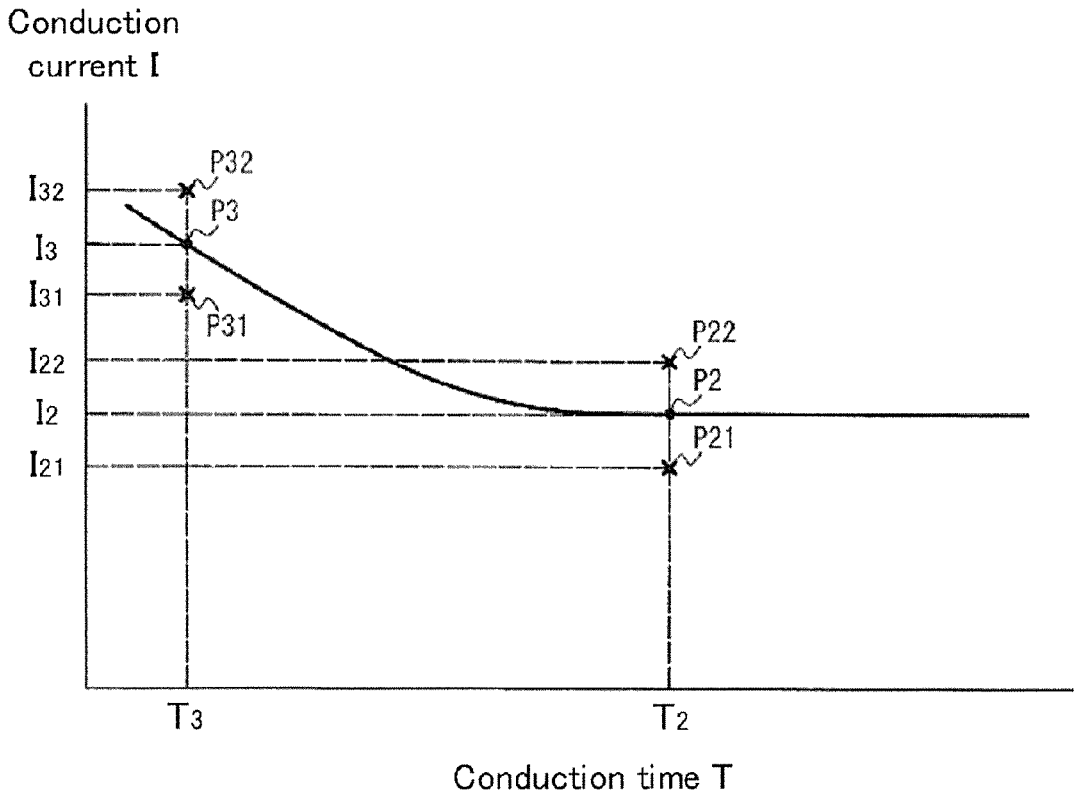
FIG. 12 is a diagram for explaining the melting conduction signal and the non-melting conduction signal according to a first modification example.

FIG. 12 is a diagram for explaining the melting conduction signal and the non-melting conduction signal according to a first modification example. In the first modification example, the melting conduction signal and the non-melting conduction signal are set for the characteristic point P2 in the minimum conduction current region and the characteristic point P3 having a current value larger than the characteristic point P2.

Specifically, as shown in FIG. 12, the melting conduction signal at the point P22 corresponding to the characteristic point P2 is composed of the conduction time $T_2$ of the characteristic point P2 and the conduction current $I_{22}$ which is larger than the conduction current $I_2$ of the characteristic point P2. The non-melting conduction signal at the point P21 corresponding to the characteristic point P2 is composed of the conduction time $T_2$ of the characteristic point P2 and the conduction current $I_{21}$ which is smaller than the conduction current $I_2$ of the characteristic point P2. Similarly, the melting conduction signal at the point P32 corresponding to the characteristic point P3 is composed of the conduction time $T_3$ of the characteristic point P3 and the conduction current $I_{32}$ which is larger than the conduction current $I_3$ of the characteristic point P3.

The non-melting conduction signal at the point P31 corresponding to the characteristic point P3 is composed of the conduction time $T_3$ of the characteristic point P3 and the conduction current $I_{31}$ which is smaller than the conduction current $I_3$ of the characteristic point P3. It should be noted that, in the first modified example, the characteristic point P3 corresponds to the first characteristic point, and the characteristic point P2 corresponds to the second characteristic point.

Figure 13A:
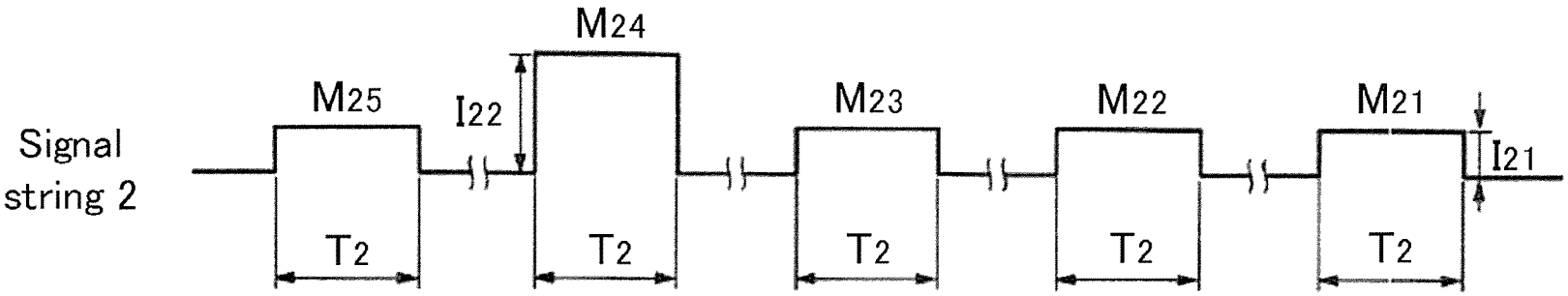
FIG. 13A is a diagram showing a signal string according to the first modification example.
Figure 13B:
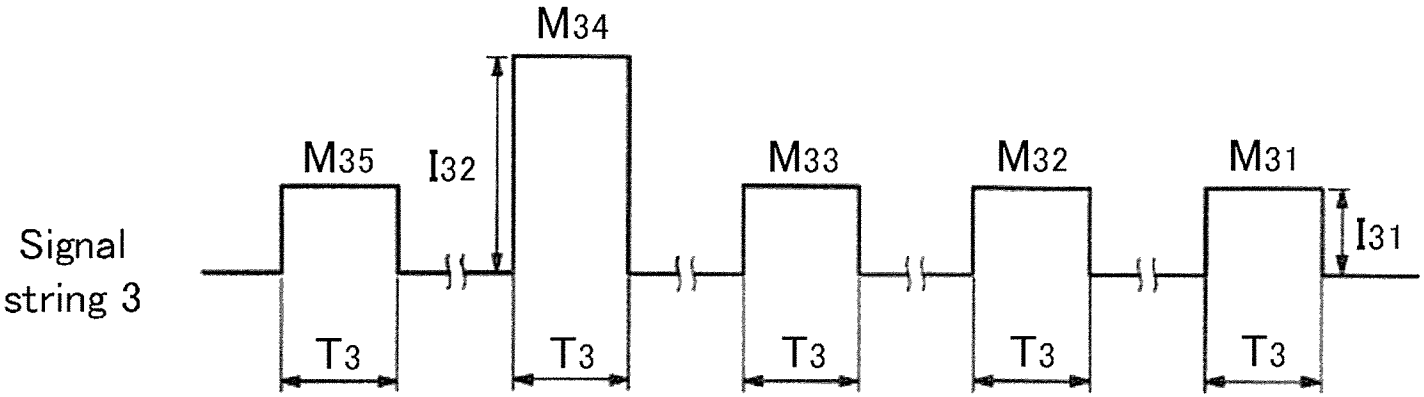
FIG. 13B is a diagram showing a signal string according to the first modification example.

FIG. 13 is a diagram showing a signal string according to the first modification example. FIG. 13A is a diagram showing a signal string 2 obtained by combining the melting conduction signal and the non-melting conduction signal corresponding to the characteristic point P2 in FIG. 12. FIG. 13B is a diagram showing a signal string 3 obtained by combining the melting conduction signal and the non-melting conduction signal corresponding to the characteristic point P3 in FIG. 12. In the signal string 2, the conduction signals $M_{21}$, $M_{22}$, $M_{23}$, and $M_{25}$ are the non-melting conduction signals and the conduction signal $M_{24}$ is the melting conduction signal. Similarly, in the signal string 3, the conduction signals $M_{31}$, $M_{32}$, $M_{33}$, and $M_{35}$ are the non-melting conduction signals and the conduction signal $M_{34}$ is the melting conduction signal.

The control part 91 applies the signal string 2 and the signal string 3 to the fuse 35. For example, the control part 91 alternately applies the conduction signal of the signal string 2 and the conduction signal of the signal string 3 (for example, applying the conduction signals in the order of $M_{21}$, $M_{31}$, $M_{22}$, $M_{32}$, $M_{23}$, . . . ) and detects whether or not the fuse 35 is molten. As described above, by applying the conduction signal corresponding to the plurality of characteristic points, even a non-genuine product, whose current value in the minimum melting current region is similar to a genuine product, can be properly specified by the signal string 3 corresponding to characteristic point P3. It should be noted that, in the above description, the melting conduction signal and the non-melting conduction signal are set for the two characteristic points P2 and P3, but it is not so limited and the melting conduction signal and the non-melting conduction signal may be set for three or more characteristic points.

The Second Modification Example

Figure 14:
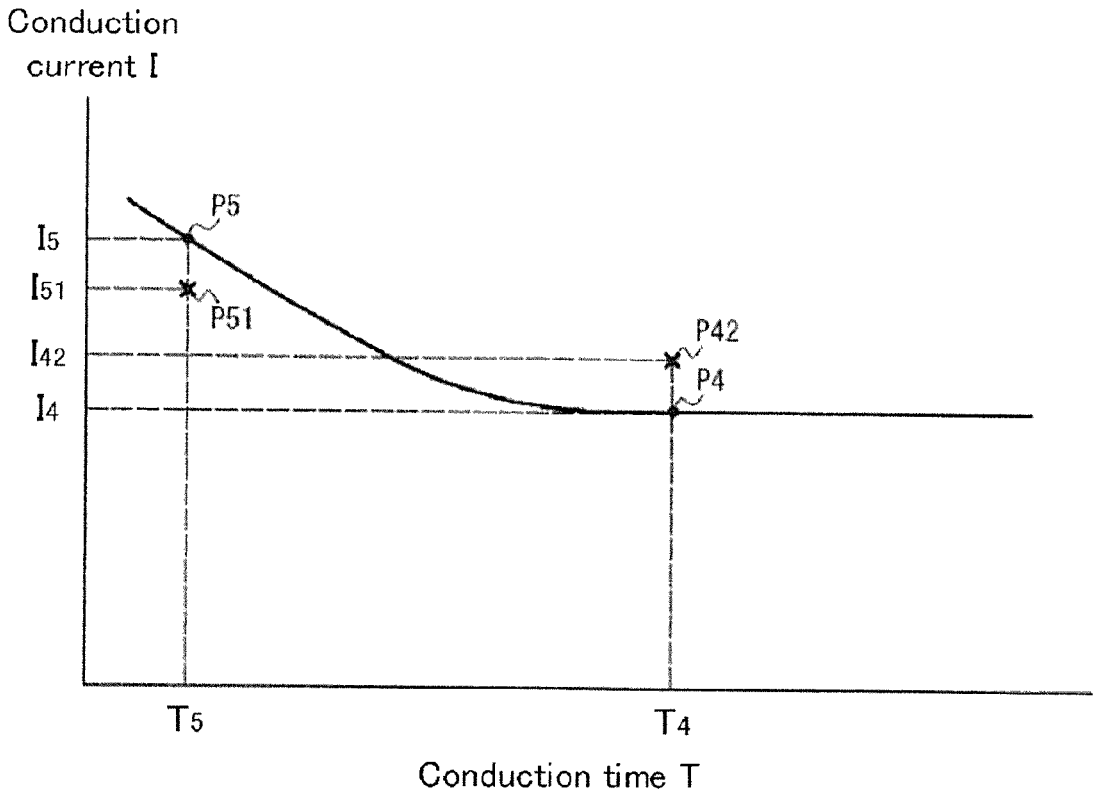
FIG. 14 is a diagram for explaining the melting conduction signal and the non-melting conduction signal according to a second modification example.

FIG. 14 is a diagram for explaining the melting conduction signal and the non-melting conduction signal according to a second modification example. In the second modification example, the melting conduction signal is set with respect to the characteristic point P4 in the minimum melting current region, and the non-melting conduction signal is set with respect to the characteristic point P5 whose current value is larger than the characteristic point P4.

Specifically, as shown in FIG. 14, the melting conduction signal at point P42 is composed of a conduction time $T_4$ at the characteristic point P4 and the conduction current 42 which is larger than the conduction current $I_4$ at the characteristic point P4. The non-melting conduction signal at point P51 is composed of a conduction time $T_5$ at the characteristic point P5 and the conduction current $I_{51}$ which is smaller than the conduction current $I_5$ at the characteristic point P5.

Figure 15:
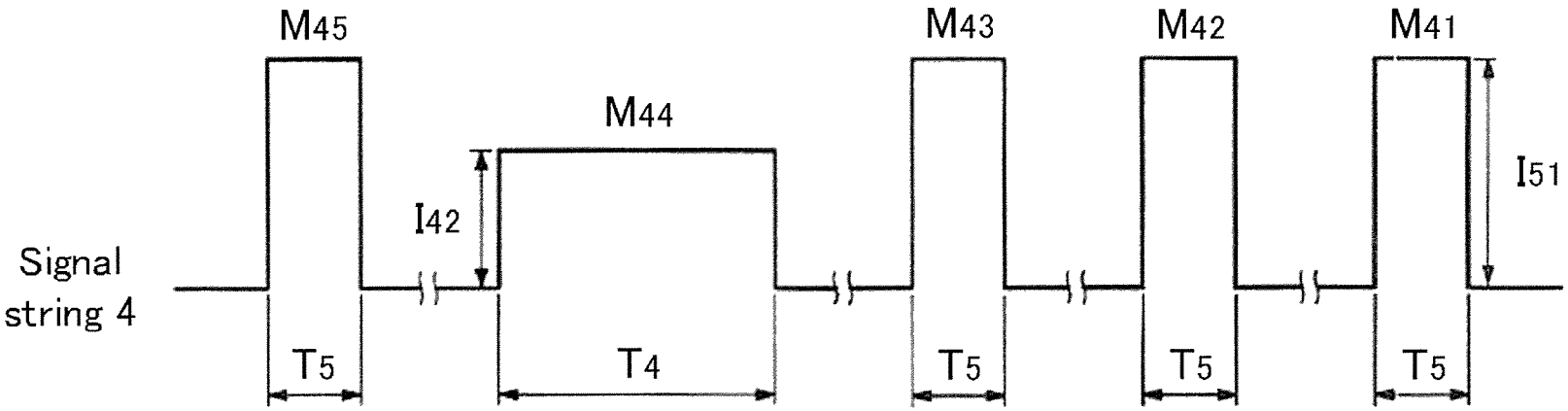
FIG. 15 is a diagram showing a signal string according to the second modification example.

FIG. 15 is a diagram showing a signal string according to the second modification example. As shown in FIG. 15, the control part 91 applies the signal string 4 obtained by combining the melting conduction signal and the non-melting conduction signal of FIG. 14 to the fuse 35. In the signal string 4, the conduction signals $M_{41}$, $M_{42}$, $M_{43}$, and $M_{45}$ are non-melting conduction signals, and the conduction signal $M_{44}$ is a melting conduction.

In the case of the second modification example, by setting the conduction current of the melting conduction signal to be larger than the conduction current of the characteristic point P4 and by setting the conduction current of the non-melting conduction signal to be smaller than the conduction current of the characteristic point P5, the fuse 35 with the pre-arcing time-current characteristic curve having a large slope between the characteristic point P4 and the characteristic point P5 can be properly distinguished from the other fuses. Because it is easier to determine whether the toner unit 30 is a genuine product or a non-genuine product when, in particular, the toner unit 30 on which the fuse 35 having a steep pre-arcing time-current characteristic curve is mounted is a genuine product, the present example is more effective.

The Third Modification Example

In the above description, the melting conduction signals of the signal string and the non-melting conduction signal each has one current value, but it is not so limited. For example, as shown in FIG. 16, there may be a plurality of current values of the non-melting conduction signal and the melting conduction signal.

Figure 16:
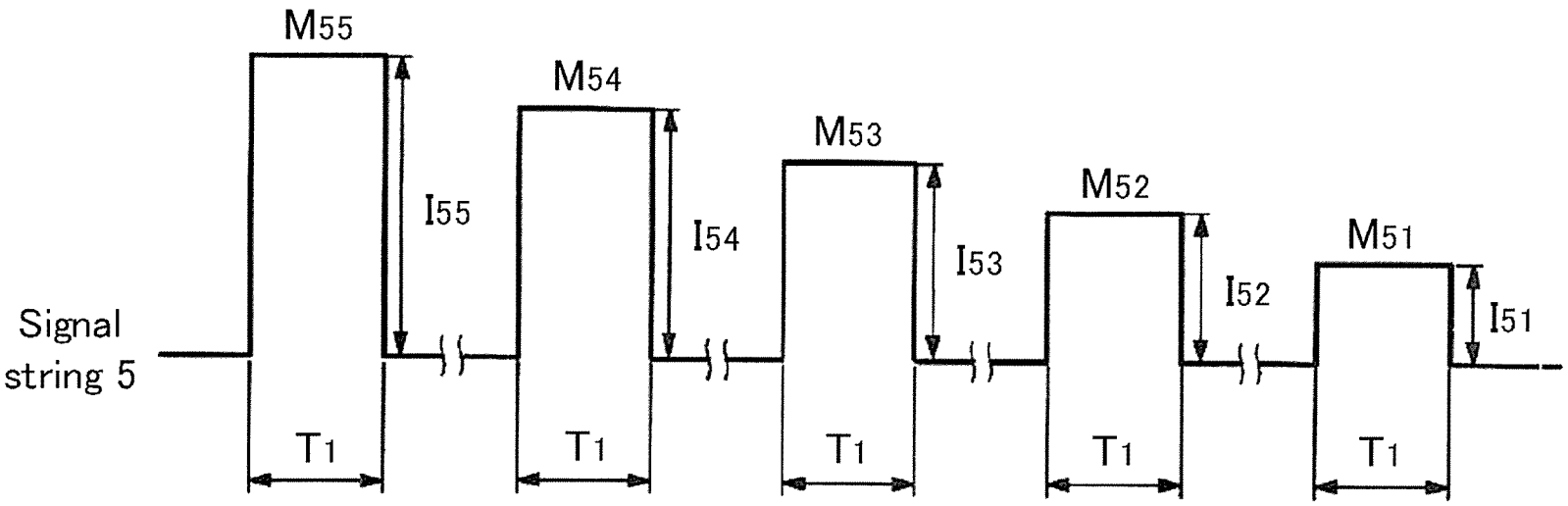
FIG. 16 is a diagram showing a signal string according to a third modification example.

FIG. 16 is a diagram showing a signal string according to the third modification example. The signal string 5 shown in FIG. 16 includes five conduction signals, and conduction signals $M_{51}$, $M_{52}$, and $M_{53}$ are the non-melting conduction signals and conduction signals $M_{54}$ and $M_{55}$ are the melting conduction signals. The five conduction signals are set for, for example, one characteristic point on the pre-arcing time-current characteristic curve. As can be seen in FIG. 16, the current values of the conduction signals $M_{51}$, $M_{52}$, $M_{53}$, $M_{54}$, and $M_{55}$ are respectively different from each other and set stepwise. The conduction times of the five conduction signals are the same.

The control part 91 sequentially applies conduction signals constituting the signal string 5 to the fuse 35, and determines whether the toner unit 30 is a genuine product or a non-genuine product by detecting whether or not the fuse 35 is molten. In this manner, since it is possible to detect whether or not the fuse 35 is molten by subdividing the current value, a genuine toner unit 30 and a non-genuine toner unit 30 can be determined with high accuracy.

It should be noted that, in the above description, the determination of whether the toner unit 30 is a genuine product or a non-genuine product is described as an example of the determination as to whether or not the exchange unit is the specific exchange unit, but it is not so limited. For example, it may be determined whether the toner unit is a high-definition image forming toner unit (specific exchange unit) or a standard image forming toner unit.

Further, in the above description, an electrophotographic printer is described as an example of an image forming device, but it is not so limited. The image forming device may be a copying machine, a facsimile, a multifunctional printer, or the like. Furthermore, the printer may adopt a so-called ink jet system.

Moreover, in the above description, the control circuit 90 of the device main body 3 is connected to the unit-side circuit 80 of the toner unit 30, which is the exchange unit, via the connector 75, but it is not so limited. For example, the control circuit 90 may be wirelessly connected to the unit-side circuit 80.

The present invention is explained with the exemplary embodiments of the present invention but the technical scope of the present invention is not limited to the scope described in the above embodiment. It is apparent for those skilled in the art that it is possible to make various changes and modifications to the embodiment. It is apparent from the description of the scope of the claims that the forms added with such changes and modifications are included in the technical scope of the present invention.

What is claimed is:

1. An image forming device comprising:

an attachment part to which an exchange unit having a fuse that can be molten by being supplied with an electric current is detachably attached; and a control part that applies to the fuse each of a first conduction signal corresponding to a first current supply state where a fuse of a specific exchange unit is not molten and a second conduction signal corresponding to a second current supply state where the fuse of the specific exchange unit is molten, the control part determining that the exchange unit attached to the attachment part is the specific exchange unit when the control part detects that the fuse is not molten by applying the first conduction signal and also detects that the fuse is molten by applying the second conduction signal, and the control part determining that the exchange unit attached to the attachment part is an exchange unit other than the specific exchange unit when the control part detects that the fuse is molten by applying the first conduction signal or when the control part detects that the fuse is not molten by applying the second conduction signal.

2. The image forming device according to claim 1, wherein the control part applies a signal string obtained by combining the first conduction signal and the second conduction signal to the fuse.

3. The image forming device according to claim 2, further comprising:

a storage part that stores a plurality of signal strings whose patterns of conduction signals are different from each other, wherein the control part applies the signal string to the fuse by selecting one or a plurality of signal strings from the plurality of signal strings.

4. The image forming device according to claim 3, wherein the control part applies the signal string to the fuse by randomly selecting the one or the plurality of signal strings from the plurality of signal strings.

5. The image forming device according to claim 1, wherein the control part sets each of the first current supply state and the second current supply state with a current value and a conduction time based on a pre-arcing time-current characteristic curve showing a relationship of current values and conduction times for melting the fuse, the conduction time of the first current supply state is the same as the conduction time of the second current supply state, and the current value of the first current supply state is different from the current value of the second current supply state.

6. The image forming device according to claim 5, wherein the control part sets the conduction times of the first current supply state and the second current supply state to be the same as the conduction time corresponding to one characteristic point on the pre-arcing time-current characteristic curve, the control part sets the current value of the first current supply state to be smaller than the current value corresponding to the characteristic point, and the control part sets the current value of the second current supply state to be larger than the current value corresponding to the characteristic point.

7. The image forming device according to claim 5, wherein the control part sets the first current supply state and the second current supply state on the basis of a current value and a conduction time corresponding to each of a first characteristic point and a second characteristic point on the pre-arcing time-current characteristic curve.

8. The image forming device according to claim 7, wherein the current value corresponding to the first characteristic point is larger than the current value corresponding to the second characteristic point, and the control part sets the current value of the first current supply state to be smaller than the current value corresponding to the first characteristic point, and the control part sets the current value of the second current supply state to be larger than the current value corresponding to the second characteristic point.

9. The image forming device according to claim 5, wherein the first current supply state and the second current supply state each correspond to a plurality of current values, and the control part sets the plurality of current values corresponding to the first current supply state and the second current supply state in a stepwise manner.

10. The image forming device according to of claim 1, wherein the control part applies the second conduction signal to the fuse after applying at least one first conduction signal to the fuse.

11. The image forming device according to claim 1, further comprising:

a storage part that stores setting information on whether or not the fuse is molten by applying each of the first conduction signal and the second conduction signal, wherein the control part determines whether or not the exchange unit attached to the attachment part is the specific exchange unit by comparing a detection result of whether or not the fuse is molten and the setting information.

12. The image forming device according to claim 1, wherein the control part determines whether or not the fuse is molten by detecting the voltage between terminals of the fuse of the exchange unit when the exchange unit is attached to the attachment part, and the control part determines whether or not the exchange unit is the specific exchange unit by applying the first conduction signal and the second conduction signal to the fuse when the control part determines the fuse is not molten.

13. An exchange unit that is detachably attached to an image forming device, the exchange unit comprising:

a fuse that can be molten by being supplied with a current; and a voltage signal output part that is connected to the fuse, wherein the fuse receives a current signal string inputted from the image forming device and obtained by combining a first conduction signal corresponding to a first current supply state where a fuse of a specific exchange unit is not molten and a second conduction signal corresponding to a second current supply state where the fuse of the specific exchange unit is molten, the voltage signal output part outputs to the image forming device each of a first voltage signal of the current signal string corresponding to a voltage between terminals of the fuse caused by applying the first conduction signal and a second voltage signal of the current signal string corresponding to a voltage between terminals of the fuse caused by applying the second conduction signal, and the exchange unit attached to the image forming device is determined to be the specific exchange unit, with the first voltage signal and the second voltage signal, when the fuse is not detected to be molten by applying the first conduction signal and the fuse is detected to be molten by applying the second conduction signal, and the exchange unit attached to the image forming device is determined to be an exchange unit other than the specific exchange unit, with the first voltage signal and the second voltage signal, when the fuse is detected to be molten by applying the first conduction signal or when the fuse is not detected to be molten by applying the second conduction signal.

14. The exchange unit according to claim 13, wherein the current signal string is a signal string obtained by combining a plurality of the first conduction signals and one second conduction signal.

15. A method for determining an exchange unit, including a fuse that can be molten by being supplied with an electric current, that is detachably attached to an image forming device, the method comprising the steps of:

applying to the fuse each of a first conduction signal corresponding to a first current supply state where a fuse of a specific exchange unit that can be molten by being supplied with an electric current is not molten and a second conduction signal corresponding to a second current supply state where the fuse of the specific exchange unit is molten to the fuse; and determining that the exchange unit attached to the image forming device is the specific exchange unit when the fuse is not detected to be molten by applying the first conduction signal and the fuse is detected to be molten by applying the second conduction signal, and determining that the exchange unit attached to the image forming device is an exchange unit other than the specific exchange unit when the fuse is detected to be molten by applying the first conduction signal or when the fuse is not detected to be molten by applying the second conduction signal.

* * * * *